US006279921B2

(12) United States Patent
Božinović

(10) Patent No.: US 6,279,921 B2
(45) Date of Patent: Aug. 28, 2001

(54) INLINE SKATES WITH TWO BRAKES USED SIMULTANEOUSLY

(76) Inventor: Zoran Božinović , Kraljia Milutina 1/2 11000, Beograd (YU)

( * ) Notice: Subject to any disclaimer, the term of this patent is extended or adjusted under 35 U.S.C. 154(b) by 0 days.

(21) Appl. No.: 09/728,509

(22) Filed: Dec. 1, 2000

Related U.S. Application Data

(63) Continuation of application No. 09/403,964, filed on Nov. 1, 1999.

(30) Foreign Application Priority Data

May 8, 1997 (WO) ..... PCT/YU98/0012

(51) Int. Cl.[7] ..... A63C 17/14

(52) U.S. Cl. ..... 280/11.206; 188/5; 280/11.215; 280/11.231

(58) Field of Search ..... 280/11.204, 11.221, 280/11.206, 11.211, 11.215, 11.216, 11.217, 11.231; 188/4 R, 4 B, 5

(56) References Cited

U.S. PATENT DOCUMENTS

| | | |
|---|---|---|
| 333,751 | 1/1886 | Harris, Jr. . |
| 3,224,785 | 12/1965 | Stevenson . |
| 4,453,726 | 6/1984 | Ziegler . |
| 5,088,748 | 2/1992 | Koselka et al. . |
| 5,183,275 | 2/1993 | Hoskin . |
| 5,232,231 | 8/1993 | Carlsmith . |
| 5,280,931 | 1/1994 | Horton . |
| 5,375,859 | 12/1994 | Peck et al. . |
| 5,401,038 | 3/1995 | Peck et al. . |
| 5,413,362 | 5/1995 | De Santis . |
| 5,501,474 | 3/1996 | Conte . |
| 5,791,663 | 8/1998 | Klukos . |

FOREIGN PATENT DOCUMENTS

| | | |
|---|---|---|
| 2747049 | 4/1996 | (FR) . |

*Primary Examiner*—Michael Mar
(74) *Attorney, Agent, or Firm*—Patterson, Thuente, Skaar & Christensen, P.A.

(57) ABSTRACT

The present inline skates have a braking system allowing the brakes to be used simultaneously. One embodiment of the invention comprises a frame with a rear wheel carrier and a braking wheel carrier rotatingly mounted on the frame through a first cylinder and an axle and interlocking through a notch on a braking wheel carrier and a fourth cylinder on a first rear wheel carrier while the first rear wheel and a braking wheel are rotatingly mounted on their respective carriers. Another mobile rear wheel is handled by its carrier rotatingly mounted on the second cylinder affixed to the frame. The braking force is regulated through a screw and a pair of friction cylinders. Carrier rotation limiting cylinders are affixed to the frame. The front wheels are standard fixed wheels rotatingly mounted on the frame.

30 Claims, 2 Drawing Sheets

INLINE SKATES WITH TWO BRAKES USED SIMULTANEOUSLY

This application is a con of Ser. No. 06/403,964 filed Nov. 1, 1999.

BACKGROUND OF THE INVENTION

This invention relates to a special kind of inline skated featuring an extra efficient braking system. Such skates are a sports requisite. As far as is known inline skates with similar characteristics have never been invented or made.

The object of this invention is to create a braking system for inline skates which makes it possible for two brakes to be used simultaneously. This invention is sharply contrasted to a single brake braking system with all its variations (see document U.S. Pat. No. 5,183,275) widely practiced today and which is highly ineffective. Namely, it allows the skater to use one brake only, during braking action) which causes the problem of balance. To solve the problem of balance, the skater must use a brake only to 30–40% of its actual braking power.

By contrast our braking system by putting to work two brakes (at the same time) eliminates the problem of balance and allows both brakes to be used up to 100% of their braking potential from the very beginning of the braking action.

SUMMARY OF THE INVENTION

The main characteristic of inline skates with two brakes to be used simultaneously according to the invention is that they allow the skater to use both brakes at the same time during braking action. This kind of performance is achieved by the specific construction of the frame, the main feature of which is the introduction of the mobile rear wheel working closely with the mobile braking wheel during braking action. The said wheels are made mobile through their respective rotating carriers. A pair of rear wheel carriers rotate around cylinders incorporated in the frame while a pair of braking wheel carriers rotate around the ends of the same axle. The carriers of both said wheels are interlocked during skating through the notch (on one end) of braking wheel carrier clutching (hooking) the cylinder affixed to the rear wheel carrier. Once the braking action is over, both carriers are pushed back by their respective springs into their starting position to be interlocked eventually.

DESCRIPTION OF PREFERRED EMBODIMENT

Figure 1:
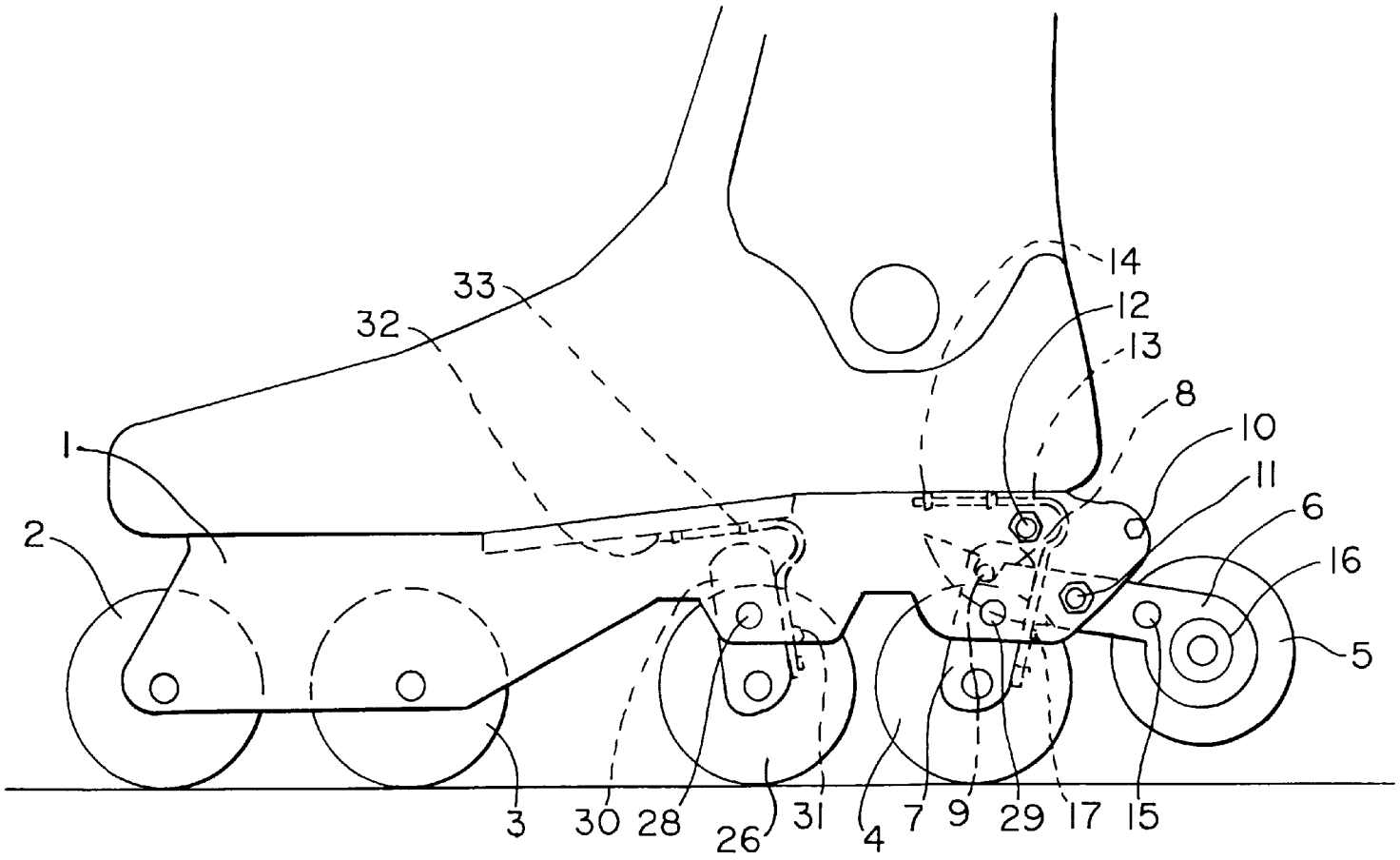
FIG. 1 is a side view of the skate during skating

FIG. 1 Shows an inline skate with frame 1 affixed to the boot. First two front wheels 2, 3, positioned inline on the frame 1, are standard fixed, non-mobile wheels. They are followed by two rear (inline) mobile wheels 25. A rear wheel 4 and a braking wheel 5 make up the braking system to be explained in detail.

Figure 3:
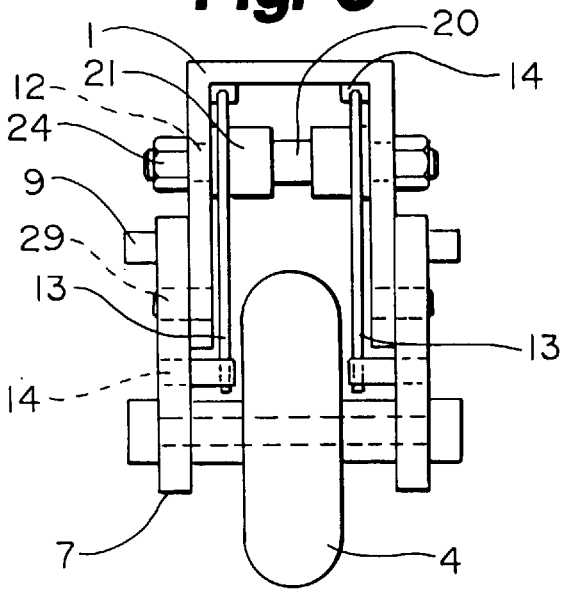
FIG. 3 is a view from behind of the rear wheel with a pair its carriers

A first rear wheel carrier 7 is rotatingly mounted on a first cylinder 29 affixed to a frame 1 (FIGS. 1,3). The first spring holders 14 are affixed to the inside of the frame 1 and to a first rear. wheel carrier 7 holding a pair of first springs 13, the purpose of which is to push back a first rear wheel carrier 7 (once braking is completed) to its starting position (FIG. 1), until they touch a sixth cylinder 17 affixed to a frame 1, which limits their backward rotation. An axle 12 is affixed to a frame 1 through a pair of nuts 24, and has fixedly mounted hollow cylinder 21 on with its mid section 20 (FIG. 3) (notch), against which one end of a pair of third springs 19 rests. A notch 8 on one end of a braking wheel carrier 6 clutches a fourth cylinder 9 affixed to a first rear wheel carrier 7, to keep a rear wheel 4 firmly in its working position during skating. On the rear end of the frame 1 there is a braking wheel carrier 6 rotatingly mounted on end of an axle 11 which is fixedly mounted on a frame 1 through a pair of screws 25.

Figure 2:
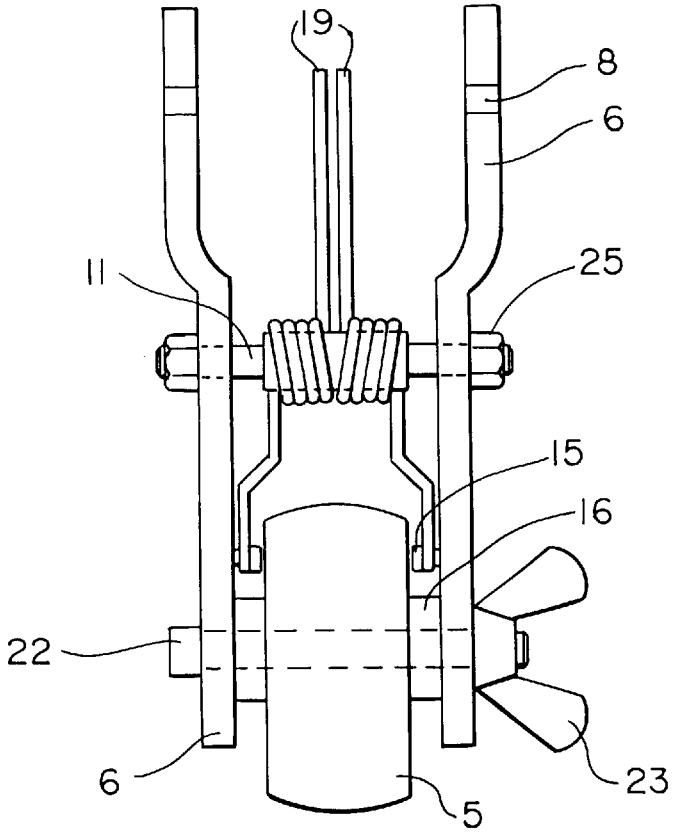
FIG. 2 is a view from above the braking wheel, and a pair of its carriers

A pair of third springs 19 (FIG. 2) is mounted on an axle 11, resting with one end against a notch 20 of a hollow cylinder 21 and with the other end against third spring holders 15 affixed to a braking wheel carrier 6. By pushing a braking wheel 5 to the ground (mounted on one end of a braking wheel carrier 6), a pair of third springs 19 help a first rear wheel carrier 7 and a braking wheel carrier 6 interlock once braking action is completed. A braking wheel 5 is rotatingly mounted on an axle 22 and constantly pinched with a pair of rubber cylinders 16 through a nut 23 which regulates a braking force of each break. A first rear wheel carrier 7 and a braking wheel carrier 6 are interlocking during skating (FIG. 1) through a notch 8 (on a braking wheel carrier 6) clutching a fourth cylinder 9 affixed to a first rear wheel carrier 7.

A third inline wheel 26 is mobile and is rotatingly mounted between a pair of its carriers 30 also rotatingly mounted on a second cylinder 28 affixed to a frame 1. During skating, a second rear wheel carrier 30 rests against a pair of seventh cylinders 31 affixed to a frame 1 due to an angle between the ground and a second rear wheel carrier 30. Once braking is completed, a pair of second springs 32 pushes back a second rear wheel carrier 30 till it touches a seventh cylinder 31 (FIG. 1). Second spring holders 33 affixed to the inside of a frame 1 and a second rear wheel carrier 30 hold a pair of second springs 32. How the braking system works? During skating (FIG. 1) a braking wheel 5 is above the ground and a first rear wheel carrier 7 and a braking wheel carrier 6 are interlocked through their respective parts, a fourth cylinder 9 and a notch 8. A second rear wheel carrier 30 under the body weight and an angle between a second rear wheel carrier 30 and the surface rests against a seventh cylinder 31. To engage the brakes, the skater should lift the front wheels 2,3 of both skates. As result, the braking wheels 5 touch the ground and their carriers 6 start to rotate around an axle 11 counter clockwise until the braking wheel carriers 6 touch fifth cylinders 10 affixed to a frame 1. The said rotation of a braking wheel carrier 6 allows its notch 8 to release a fourth cylinder 9 of a first rear wheel carrier 7. As result, under the body weight, a first rear wheel carrier 7 starts to rotate clockwise around a first cylinder 29 while a first rear wheel 4 starts pushing a second rear wheel 26 also clockwise. During the braking action, the skating is done on a front wheel 3 and a braking wheel 5 while the body weight is almost entirely on a braking wheel 5, because the mobile wheels 26,4 get disengaged rotating idly. Once braking is completed, the skates get lifted (one at a time) off the ground, which causes second springs 32, first springs 13 and third springs 19 to push their respective wheel carriers 30,7,6 into their working positions (FIG. 1) while first rear wheel carriers 7 and braking wheel carriers 6 get interlocket again as result.

I claim:

1. An inline skate braking system configured to be operably positioned on a frame of an inline skate being operated on a skating surface, the braking system comprising:

a frame cylinder extending from the frame;

first and second rear wheel carriers mounted to the inline skate frame, the second rear wheel carrier pivotable between braking and nonbraking positions and biased in said nonbraking position;

first and second rear wheels rotatively mounted to respective ones of said first and second rear wheel carriers;

a braking wheel carrier pivotally mounted to the inline skate frame for movement between a braking position and a nonbraking position, said braking wheel carrier being biased in a nonbraking position, and interlocked with the second rear wheel carrier when both of the second and the rear wheel carrier braking wheel carrier are in said nonbraking positions; and a braking wheel rotatively mounted on the braking wheel carrier, the braking wheel being adapted to be selectively pressed against the skating surface, thereby pivoting the braking wheel carrier into the braking position and releasing the second rear wheel carrier from being interlocked with the braking wheel carrier, the braking wheel carrier then contacting the frame cylinder to brake the inline skate.

2. The braking system of claim 1, further comprising structure to regulate a braking force generated by said braking system.

3. The braking system of claim 2, the braking force regulating structure comprising an axle, a plurality of rubber cylinders and a screw, the axle rotatingly mounted the braking wheel to the braking wheel carrier, the subber cylinders disposed about the axle, the screw threadingly accommodating the axle and cooperating with the rubber cylinders to regulate a braking force generated by the inline skate braking system.

4. The braking system of claim 1, further comprising a first spring attached to the frame and first rear wheel carrier and biasing the first rear wheel carrier toward the second rear wheel.

5. The braking system of claim 4, further comprising a second spring attached to the frame and second rear wheel carrier and biasing the second rear wheel carrier toward the braking wheel.

6. The braking system of claim 5, further comprising a third spring pivotally attached proximate the braking wheel carrier and biasing the braking wheel carrier in the nonbraking position.

7. The braking system of claim 1, the braking wheel carrier defining a notch and the second rear wheel carrier comprising a cylinder, the second rear wheel carrier cylinder accommodating the notch when the braking wheel carrier and the second rear wheel carrier are interlocked.

8. The braking system of claim 1, further comprising a first cylinder extending from the frame and contacting the first rear wheel carrier when the first rear wheel carrier is in said nonbraking position.

9. The braking system 8, further comprising a second cylinder extending from the frame and contacting the second rear wheel carrier when the second rear wheel carrier is in said nonbraking position.

10. The braking system of claim 9, further comprising a third cylinder extending from the frame and contacting the braking wheel carrier when the braking wheel carrier is in the braking position.

11. An inline skate, comprising:

a frame;

a frame cylinder extending from the frame;

two front wheels rotatively mounted to the frame; and a braking system operably positioned proximate the front wheels and comprising:

first and second rear wheel carriers mounted to the frame, both rear wheel carrier being pivotable between braking and nonbraking positions and biased in said nonbraking position, first and second rear wheels rotatively mounted to respective one of said first and second rear wheel carriers, a braking wheel carrier pivotally mounted to the frame for movement between a braking position and a nonbraking position, said braking wheel carrier being biased in a nonbraking position, and interlocked with the second rear wheel carrier when both of the second rear wheel carrier and the braking wheel carrier are in said nonbraking position, and a braking wheel rotatively mounted on the braking wheel carrier, the braking wheel being adapted to be selectively pressed against a skating surface, thereby pivoting the braking wheel carrier into the braking position and releasing the second rear wheel carrier from the braking wheel carrier, the braking wheel carrier pivoting such that the braking wheel carrier contacts the frame cylinder to brake the inline skate.

12. The inline skate of claim 11, further comprising structure to regulate a braking force generated by said braking system.

13. The inline skate of claim 12, the braking force regulating structure comprising an axle, a plurality of rubber cylinders and a screw, the axle rotatingly mounted the braking wheel to the braking wheel carrier, the subber cylinders disposed about the axle, the screw threadingly accommodating the axle and cooperating with the rubber cylinders to regulate a braking force generated by the inline skate braking system.

14. The inline skate of claim 11, the braking system further comprising a first spring attached to the frame and the first rear wheel carrier and biasing the first rear wheel carrier toward the second rear wheel.

15. The inline skate of claim 14, the braking system further comprising a second spring attached to the frame and second rear wheel carrier and biasing the second rear carrier toward the braking wheel.

16. The inline skate of claim 15, the braking system further comprising a third spring pivotally attached proximate the braking wheel carrier and biasing the braking wheel carrier in the nonbraking position.

17. The inline skate of claim 11, the braking wheel carrier defining a notch and the second rear wheel carrier comprising a cylinder, the second rear wheel carrier cylinder accommodating the notch when the braking wheel carrier and the second rear wheel carrier are interlocked and in said nonbraking positions.

18. The inline skate of claim 17, the braking system further comprising a first cylinder extending from the frame and contacting the first rear wheel carrier when the first rear wheel carrier is in said nonbraking position.

19. The inline skate of claim 18, the braking system further comprising a second cylinder extending from the frame and contacting the second rear wheel carrier when the second rear wheel carrier is in said nonbraking position.

20. The inline skate of claim 19, the braking system further comprising a third cylinder extending from the frame and contacting the braking wheel carrier when the braking wheel carrier is in the braking position.

21. A process of making an inline skate, comprising:

providing a boot;

fixing a frame to the boot, the frame including a frame cylinder;

rotatively mounting a plurality of front wheels to the frame;

operably positioning a braking system behind the front wheels, the braking system comprising:

first and second rear wheel carriers mounted to the frame, both rear wheel carriers pivotably between braking and nonbraking positions and biased in said nonbraking position, first and second rear wheels rotatively mounted to respective one of said first and second rear wheel carriers, a braking wheel carrier pivotally mounted to the inline skates frame for movement between a braking position and a nonbraking position, said braking wheel carrier being biased in a nonbraking position, and interlocked with the second rear wheel carrier when both of the second rear wheel carrier and the braking wheel carrier are in said nonbraking positions, and a braking wheel rotatively mounted on the braking wheel carrier, the braking wheel being adapted to be selectively pressed against a skating surface, thereby pivoting the braking wheel carrier to release the second rear wheel carrier from the braking wheel carrier, the braking wheel carrier further pivoting such that the braking wheel carrier contacts the frame cylinder to brake the inline skate.

22. The process of claim 21, in which the braking wheel is rotatively mounted to the braking wheel carrier by an axle extending through the braking wheel and the braking wheel carrier.

23. The process of claim 22, in which the axle is extending through a plurality of rubber cylinders and a nut is threaded onto the axle, the nut and rubber cylinders cooperating to regulate a braking force generated by the braking wheel.

24. The process of claim 21, further comprising attaching a first spring to the frame and the rear wheel carrier such that the first rear wheel carrier is biased toward the second rear wheel.

25. The process of claim 24, further comprising attaching a second spring to the frame and second rear wheel carrier such that the second rear wheel carrier is biased toward the braking wheel.

26. The process of claim 25, further comprising pivotally attaching a third spring proximate the braking wheel such that the braking wheel carrier is biased in said nonbraking position.

27. The process of claim 21, further comprising defining a notch in the braking wheel carrier and providing a cylinder on the second rear wheel carrier such that the second rear wheel carrier cylinder is accommodated by the notch when the braking wheel carrier and the second rear wheel carrier are interlocked.

28. The process of claim 27, further comprising providing a first cylinder on said frame such that the first rear wheel carrier contacts the first cylinder when the first rear wheel cylinder is in the nonbraking position.

29. The process of claim 28, further comprising providing a second cylinder on the frame such that the second cylinder contacts the second rear wheel carrier when the second rear wheel carrier is in the nonbraking position.

30. The process of claim 29, further comprising providing a third cylinder on the frame such that the third cylinder contacts the brake wheel carrier when the brake wheel carrier is in the braking position.

* * * * *